US006021757A

United States Patent [19]

Nagashima

[11] Patent Number: 6,021,757

[45] Date of Patent: Feb. 8, 2000

[54] HANDLING DEVICE FOR A POWER WORKING MACHINE

[75] Inventor: Akira Nagashima, Kanagawa, Japan

[73] Assignee: Kioritz Corporation, Tokyo, Japan

[21] Appl. No.: 09/074,326

[22] Filed: May 7, 1998

[30] Foreign Application Priority Data

May 16, 1997 [JP] Japan ..... 9-127536

[51] Int. Cl.[7] ..... F02D 7/00

[52] U.S. Cl. ..... 123/400

[58] Field of Search ..... 123/398, 400

[56] References Cited

U.S. PATENT DOCUMENTS

| | | | |
|---|---|---|---|
| 5,067,365 | 11/1991 | Lauer | 74/501.5 |
| 5,685,271 | 11/1997 | Taomo et al. | 123/398 |
| 5,718,052 | 2/1998 | Taomo et al. | 123/398 |
| 5,862,713 | 1/1999 | Tsunoda et al. | 123/398 |
| 5,865,155 | 2/1999 | Nagashima | 123/398 |
| 5,868,377 | 2/1999 | Taomo et al. | 123/400 |
| 5,871,202 | 2/1999 | Taomo et al. | 123/400 |

FOREIGN PATENT DOCUMENTS

| | | | |
|---|---|---|---|
| 2 658 879 | 8/1991 | France | 123/400 |
| 58-77133 | 5/1983 | Japan | 123/400 |
| 2 192 227 | 1/1988 | United Kingdom | 123/400 |

*Primary Examiner*—Erick R. Solis
*Attorney, Agent, or Firm*—Baker & Botts, L.L.P.

[57] ABSTRACT

A handling device for setting the opening degree of the throttle valve to a desired degree even under conditions where the throttle lever is rotated to a full extent, and capable of immediately returning the throttle lever to a minimum opening degree (idling opening). The handling device has a main lever connected with one end portion of a cable and designed to pull the cable connected via the other end portion thereof with an actuating member, a movable pulley around which a portion of the cable in the vicinity of the one end portion is wound as a turn-around point, and a position adjustment mechanism comprising a sub-lever. The sub-lever is designed to move the movable pulley to a desired holding position so as to adjust a distance of pulling the cable.

5 Claims, 9 Drawing Sheets

HANDLING DEVICE FOR A POWER WORKING MACHINE

BACKGROUND OF THE INVENTION

This invention relates to a handling device for a power working machine and, more particularly, to a lever mechanism of a handling device which is rotatably attached to the rear portion of a portable power working machine such as a hedge trimmer.

A portable power working machine such as a hedge trimmer generally has a power source case enclosing a power source such as an internal combustion engine or an electric motor, a mount base portion enclosing a transmission case including a power transmission device such as gears to be actuated by the power source, a working portion comprising clipper blades to be actuated via the power transmission device by the power source, and a handling portion attached to the power source case or the mount base portion. For convenience of manipulation, the handling portion includes a front handle portion and a rear handle portion. The rear handle portion is provided with a throttle lever for adjusting the opening degree of a throttle valve in case of the internal combustion engine is to be employed as a power source.

Generally, the throttle lever is manipulated with an operator's finger, and the opening degree of the throttle valve is adjusted by rotationally manipulating the throttle lever via a throttle cable. In a typical carburetor design, the throttle valve is normally biased at a minimum opening degree (idling opening) for maintaining the throttle valve at the idling opening. When the throttle cable is pulled by a predetermined length or more, play is eliminated and the throttle valve moves from the idling opening to a high-speed rotation opening.

The throttle lever for controlling the opening degree of the throttle valve is of automatic-opening-return type, automatically to return the lever together with the throttle valve to the initial position (idling opening) whenever manipulation of the throttle valve is suspended. With such a throttle lever, the internal combustion engine automatically returns to idling when the operator's finger releases the throttle lever. Thus, if the working machine is designed with transmission of engine driving force to the working portion via a centrifugal clutch, the centrifugal clutch is brought into a cutoff condition upon releasing of the finger, so that power transmission to the working portion is interrupted and operation of the working portion is terminated. However, if it is desired to perform work with the throttle valve at an intermediate opening degree, the throttle lever must be maintained at a desired intermediate rotational position with the finger. As the finger fatigues, manipulation may become irregular.

As a remedy, a hand lever device for a portable power working machine has been proposed wherein a sub-lever is mounted, in addition to a main throttle lever, for pulling and adjusting a cable connected with the throttle valve by making use of a turn around member such as a movable pulley, and for making the turn around member movable by making use of a throttle lever (Japanese Patent Unexamined Publication H/8-303262). As the opening degree of the throttle valve can be adjusted, via a cable, by making use of the sub-lever in such a hand lever device for a portable power working machine, the opening degree of the throttle valve can be set to a desired degree even under conditions where the throttle lever is fully rotated, and still the throttle lever can be immediately returned to the minimum opening degree (idling opening).

However, the distance of pulling the cable connected with the throttle valve by means of the sub-lever in such a hand lever device for a portable power working machine is equivalent to the distance of rotating the sub-lever, so that it is impossible to adjust the opening degree throughout the entire opening degree range of the throttle valve unless the sub-lever is rotated to a relatively large extent. Therefore, in order to assure a required distance of rotation of the sub-lever, a relatively large rotation range is required, making it difficult to miniaturize the device. Furthermore, since the sub-lever is spaced away from the throttle lever as a main lever by a relatively large distance, it is difficult to adjust the sub-lever while holding the throttle lever with a finger, thus impairing operability.

SUMMARY OF THE INVENTION

The invention has been made to cope with the aforementioned difficulties, and it is an object of the invention to provide a throttle lever mechanism for a handling device, allowing miniaturization of the whole size of the handling portion of a portable power working machine, and capable of setting the opening degree of the throttle valve to a desired degree even under conditions where the throttle lever is rotated to a full extent, and capable also of immediately returning the throttle lever to the minimum opening degree (idling opening).

For realizing the aforementioned object, the invention provides a handling device with (i) a main lever connected with one end portion of a cable, for pulling the cable connected via the other end portion thereof with an actuating member, (ii) a movable pulley around which a portion of the cable in the vicinity of the aforementioned one end portion is wound as a turn-around point, and (iii) a position adjustment mechanism comprising a sub-lever for moving the movable pulley to a desired holding position so as to adjust a distance of pulling the cable.

In this device, as the cable is pulled by the movable pulley around which the cable is wound when the sub-lever of the position adjustment mechanism is manipulated to pull the cable, the cable can be pulled by a distance which is almost twice as large as the shifted distance of the movable pulley. Therefore, the distance of manipulating the sub-lever, which is required for adjusting the opening degree of the throttle valve, i.e. the distance of shifting the movable pulley, can be reduced to half of the moving distance of the cable, thus making it possible to miniaturize the apparatus in this respect.

In a preferred embodiment of the handling device according to the invention, the position adjusting mechanism has a rotatable axle provided thereon, with a housing in which the movable pulley is rotatably, eccentrically and axially supported, an outer circumferential serration axle disposed on one end portion of the rotatable axle, and an inner circumferential serration axle provided with an inner circumferential serration engaging with the outer circumferential serration axle. The sub-lever is integrally attached to one end portion of the inner circumferential serration axle. The outer circumferential serration axle is integrally secured by means of a fastening screw with the inner circumferential serration axle. The rotatable axle and the inner circumferential serration axle are pivotally mounted on a main case, and a corrugated spring washer is interposed between the sub-lever and the main case.

According to this specific embodiment, the position adjusting mechanism can be assembled readily in a case member having binary structure (an upper member and a lower member) consisting of the main case and a closure case. Also, with the corrugated spring washer interposed between the sub-lever and the main case, the sub-lever can be frictionally sustained relative to the main case, so that the sub-lever can be adjusted and immobilized at a suitable position.

The handling device according to the invention can be applied to a power working machine comprising an internal combustion engine, a working portion to be driven by the internal combustion engine, a centrifugal clutch arranged in a power transmission system disposed between the internal combustion engine and the working portion, and a brake, wherein the handling device comprises a throttle lever attached to one end portion of a cable for pulling the cable which is connected with the throttle valve of the internal combustion engine and with the brake, a movable pulley around which a portion of the cable in the vicinity of the one end portion is wound as a turn-around point, and a position adjustment mechanism comprising a sub-throttle lever, with the sub-throttle lever being designed to move the movable pulley to a desired holding position so as to adjust a distance of pulling the cable.

The opening degree of the throttle valve can be adjusted via the cable by making use of the throttle lever and/or the sub-throttle lever constructed in this manner. Also, as the revolving power transmission portion to the working portion can be suitably controlled when shifting the engine into an idling state by manipulating the revolving power transmission portion, the working portion can be prevented from being inadvertently actuated.

DETAILED DESCRIPTION OF PREFERRED EMBODIMENTS

One embodiment of a handling device for a power working machine according to the invention will be explained below with reference to the drawings.

Figure 1:
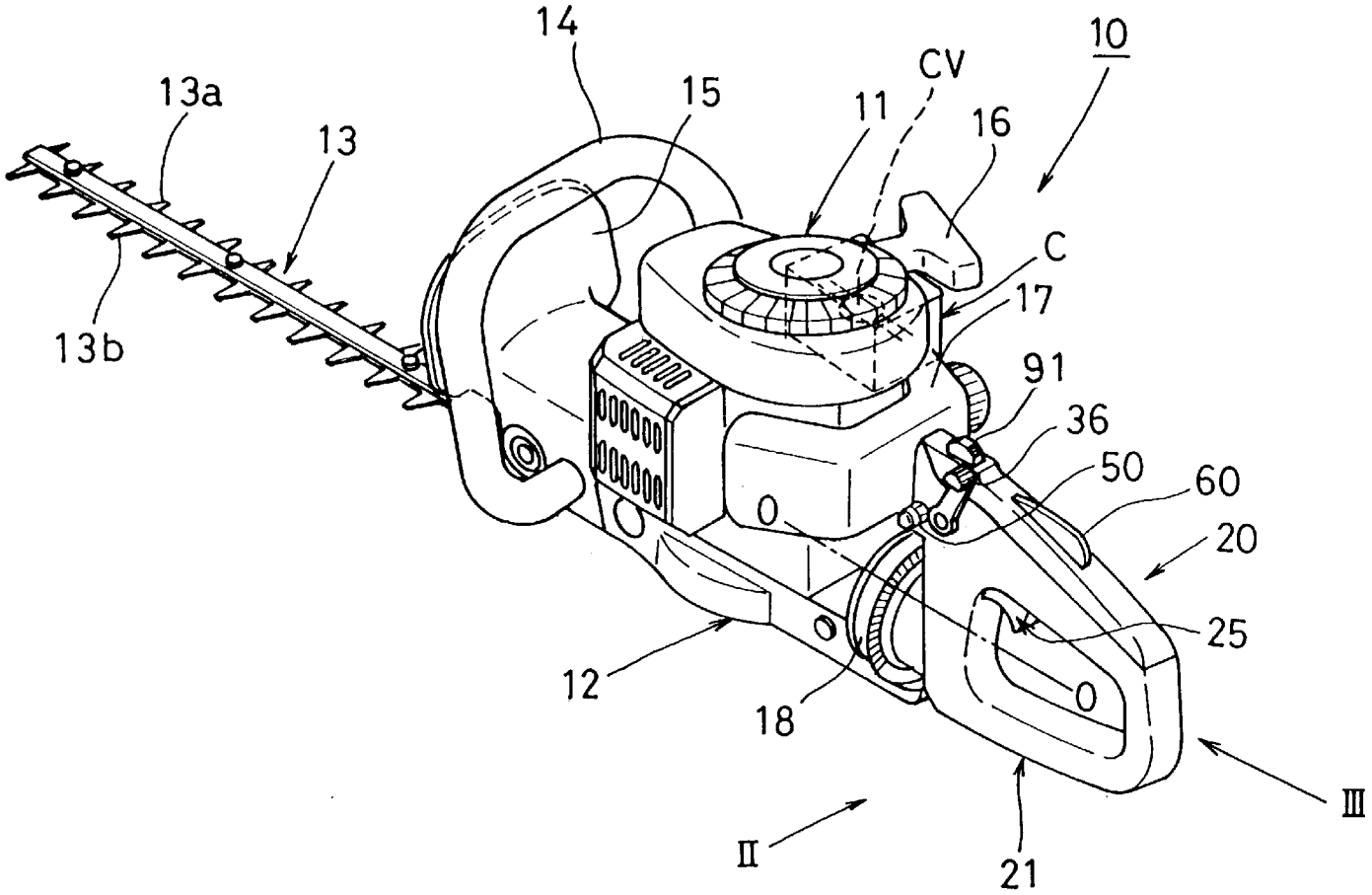
FIG. 1 is a general perspective view illustrating a hedge trimmer provided with a handling device according to one embodiment of the invention.

FIG. 1 shows a perspective view illustrating a hedge trimmer 10 with a handling device 20 which is a rear handle portion. The hedge trimmer 10 comprises an air-cooled two-stroke gasoline internal combustion engine 11 as a power source, a mount base portion 12 enclosing a transmission case including a power transmission device such as gears to be actuated by the internal combustion engine 11, a working portion 13 consisting of a pair of upper and lower clipper blades 13*a* and 13*b* which are to be actuated via the aforementioned power transmission device by the internal combustion engine 11, a loop-shaped front handle portion 14 mounted on a forward portion of the mount base 12, a hand protector 15 attached at the vicinity of the front handle portion 14, and the rear handle portion 20 mounted at a rearward portion of the mount base 12.

A recoil starter 16 and a fuel tank 17 are attached to the internal combustion engine 11 in which control members such as a carburetor C having a throttle valve CV and an spark plug (not shown) are installed. The pair of upper and lower clipper blades 13*a* and 13*b* constituting the working portion 13 are designed to be reciprocatingly driven relative to each other by means of the internal combustion engine 11 via the power transmission device such as a reciprocative motion device which is disposed in the transmission case. The rear handle portion 20 is mounted on the mount base 12 so that it is pivotally rotated about an axial line O—O which is parallel with the longitudinal axial line of the clipper blades 13*a* and 13*b*, and that it can be locked at any rotational position. A main lever (throttle lever) 25 and a sub-lever (sub-throttle lever) 36 are attached to the rear handle portion 20.

Figure 2:
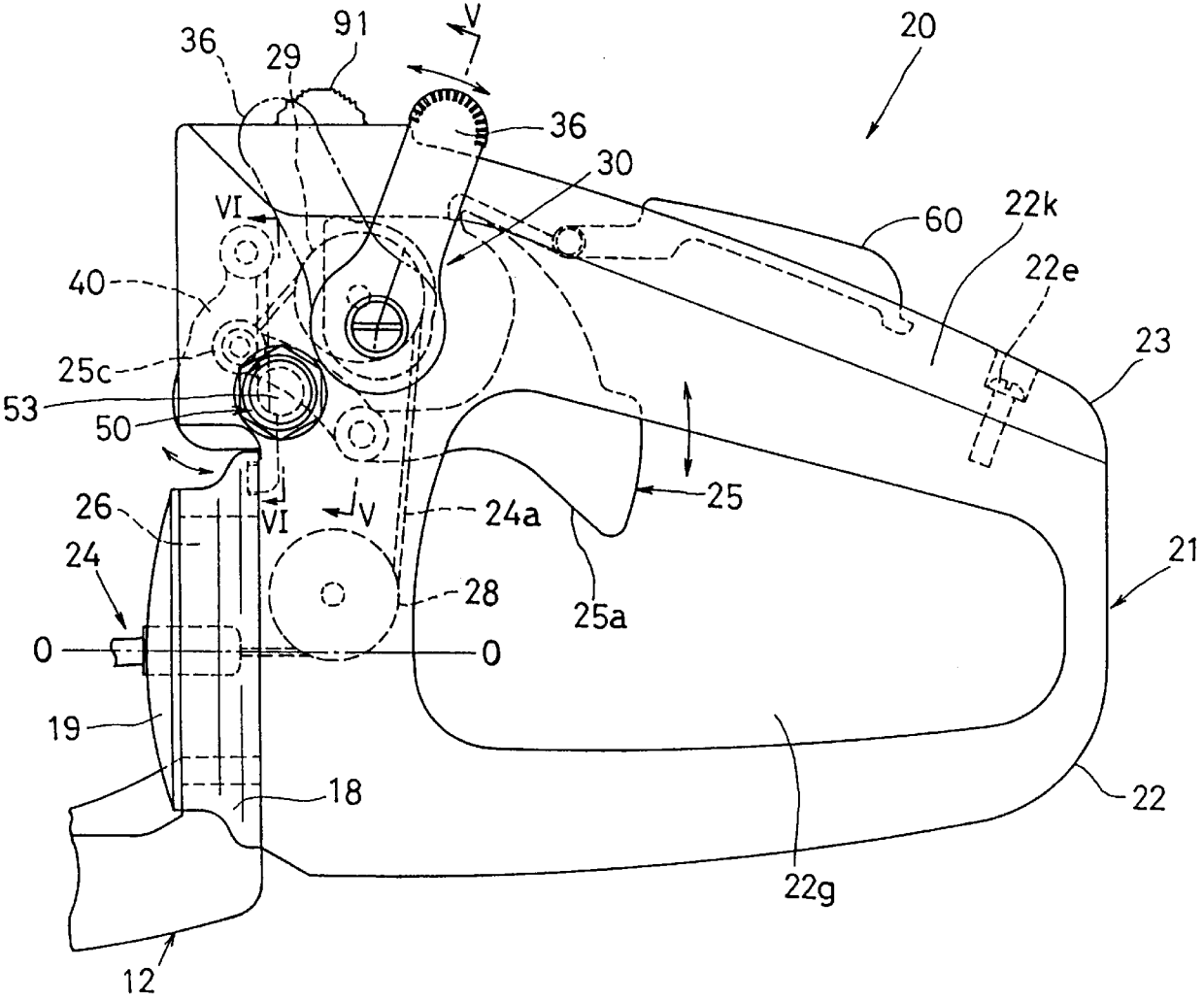
FIG. 2 is a left side view, as viewed in the direction of arrow II, of the handling device shown in FIG. 1.
Figure 3:
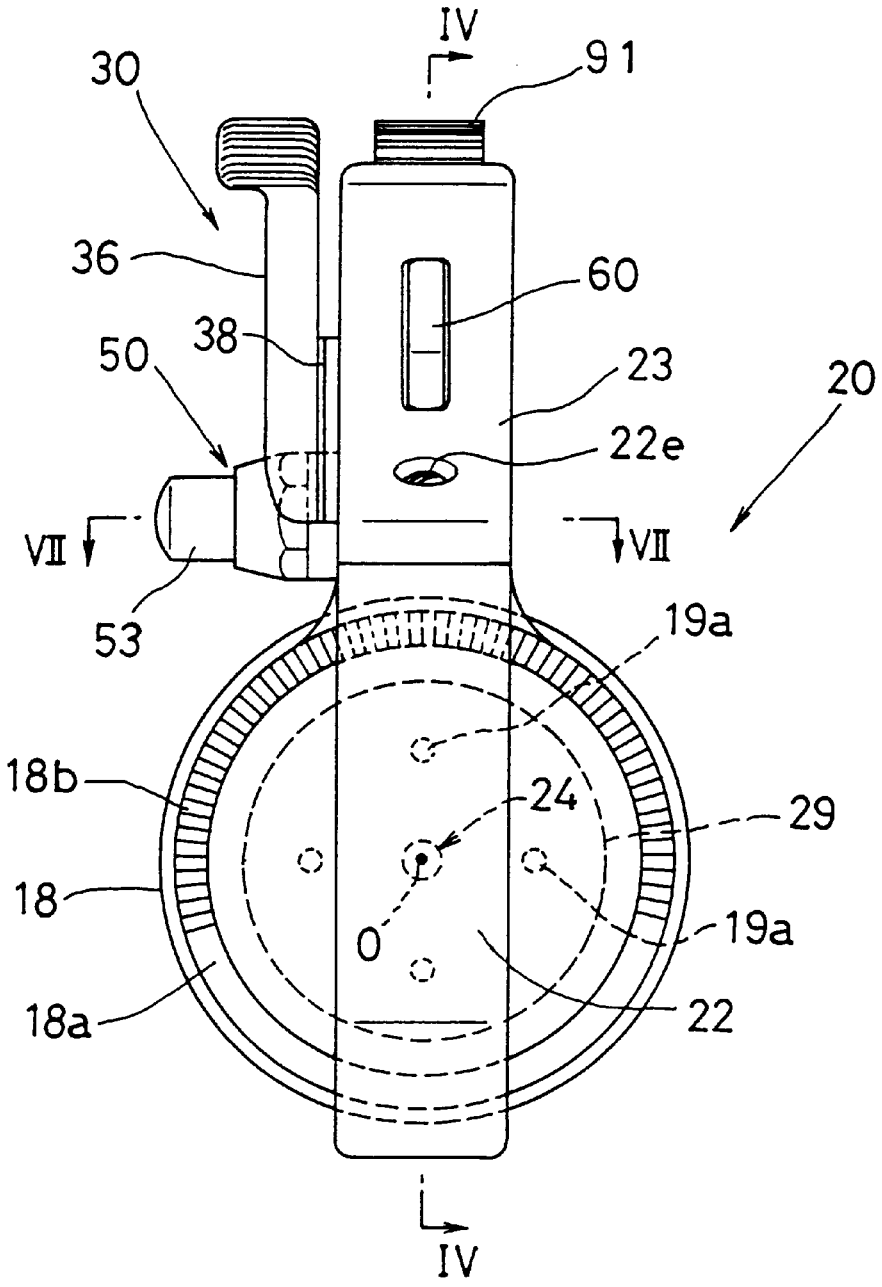
FIG. 3 is a back side view, as viewed in the direction of arrow III, of the handling device shown in FIG. 1.

FIG. 2 is a left side view, as viewed in the direction of arrow II, of the handle portion 20 shown in FIG. 1; FIG. 3 is a back side view, as viewed in the direction of arrow III in FIG. 1, of the handle portion 20; and FIG. 4 is a longitudinal sectional view, taken along the line IV—IV in FIG. 3, of the handle portion 20.

Figure 4:
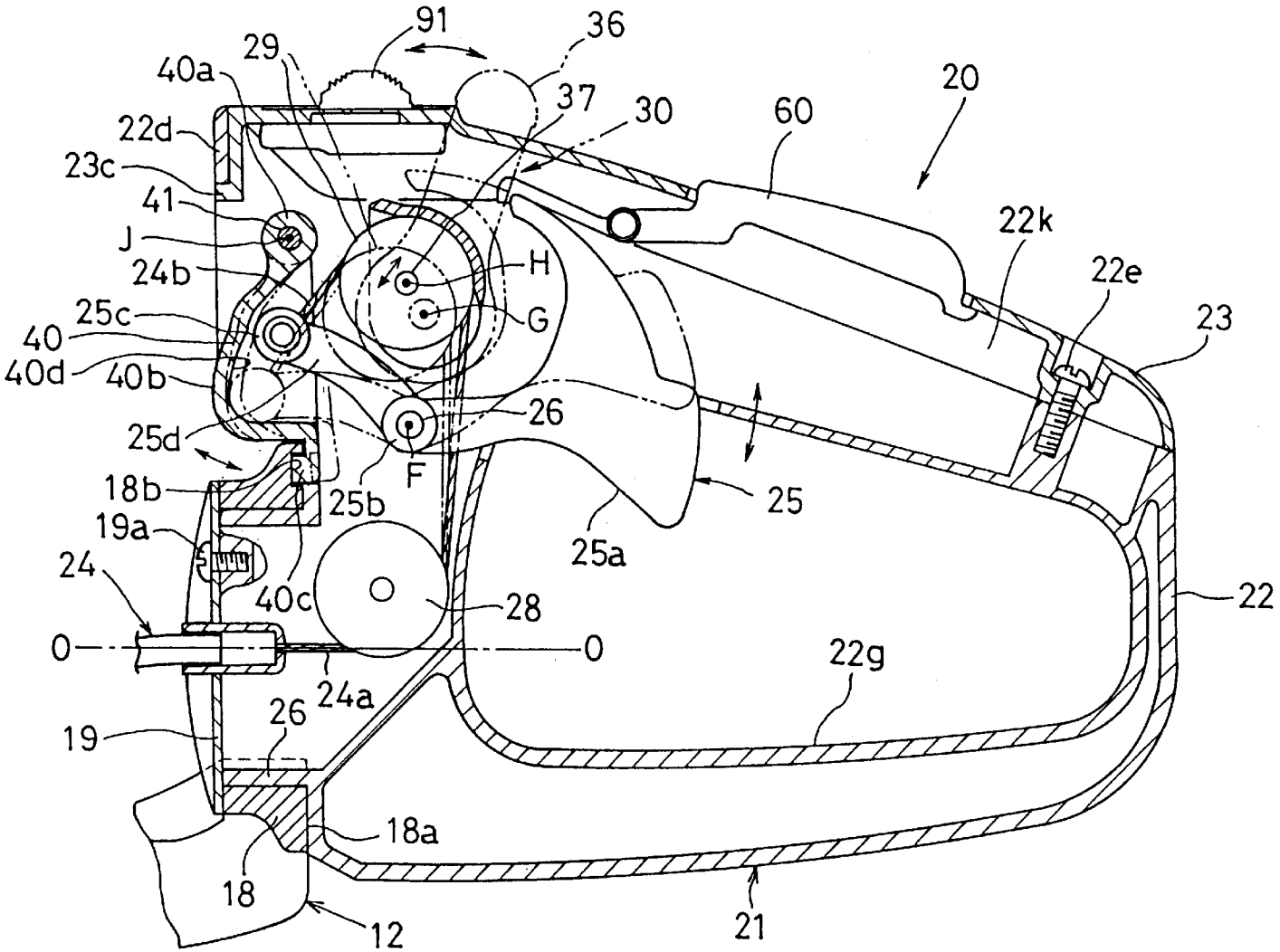
FIG. 4 is a longitudinal sectional view taken along the line IV—IV of the handling device shown in FIG. 3.

As shown in FIG. 2 (showing external appearance) and FIG. 4 (showing a cross-section), the rear handle portion 20 is provided with a hollow loop-shaped case member 21, which is rotatably mounted on the rear end portion of the mount base 12 and is designed to be locked at any rotational position. Specifically, the mount base 12 is integrally provided at its rear end portion with a cylindrical receiver 18, and the case member 21 of the rear handle portion 20 is provided at its front portion with a cylindrical supporting body 26. The cylindrical supporting body 26 is inserted into the cylindrical receiver 18, and a disk-like fixing plate 19 is contacted with the foreside (facing forward) of the cylindrical receiver 18, whereby the rear handle portion 20 is attached to the mount base 12. In this case, the disk-like fixing plate 19 is fastened to the cylindrical supporting body 26 by making use of a plurality of small screws 19*a* in such a manner that the cylindrical receiver 18 is suitably spaced apart from the disk-like fixing plate 19 and the cylindrical supporting body 26, thereby allowing the rear handle portion 20 to be rotated about the axial line O—O relative to the mount base 12.

As shown in FIG. 4, the case member 21 consists of a two-part structure comprising a main case 22 made of plastic, and a closure case 23 removably engaging with the upper opening of the main case 22. Engagement between the main case 22 and the closure case 23 is effected by inserting a projecting portion 23*c* formed at the front edge portion of the closure case 23 into an open front portion of the main case 22 so as to hook it to a locking portion 22*d* of the main case 22, after which the rear end portion of the closure case 23 is fastened to the upper surface portion of the main case 22 by means of a small screw 22*e*.

A throttle cable 24*a* inserted in a Bowden cable 24 and connected with the throttle valve CV (a member to be actuated) of the internal combustion engine 11 is guided, along the axial line O—O, into the rear handle portion 20. A throttle lever 25 for pulling the throttle cable 24*a* is in the case member 21 of the rear handle portion 20, rotatable about an axial line F—F orthogonally intersecting with the axial line O—O of the rear handle portion 20.

The main case 22 is shaped to form an open space 22*g* which enables one's hand to be inserted therein, and a grip portion 22*k* consisting of an upper portion of the main case 22 and the closure case 23 is also formed for the convenience of carrying the hedge trimmer 10 by hand.

Figure 5:
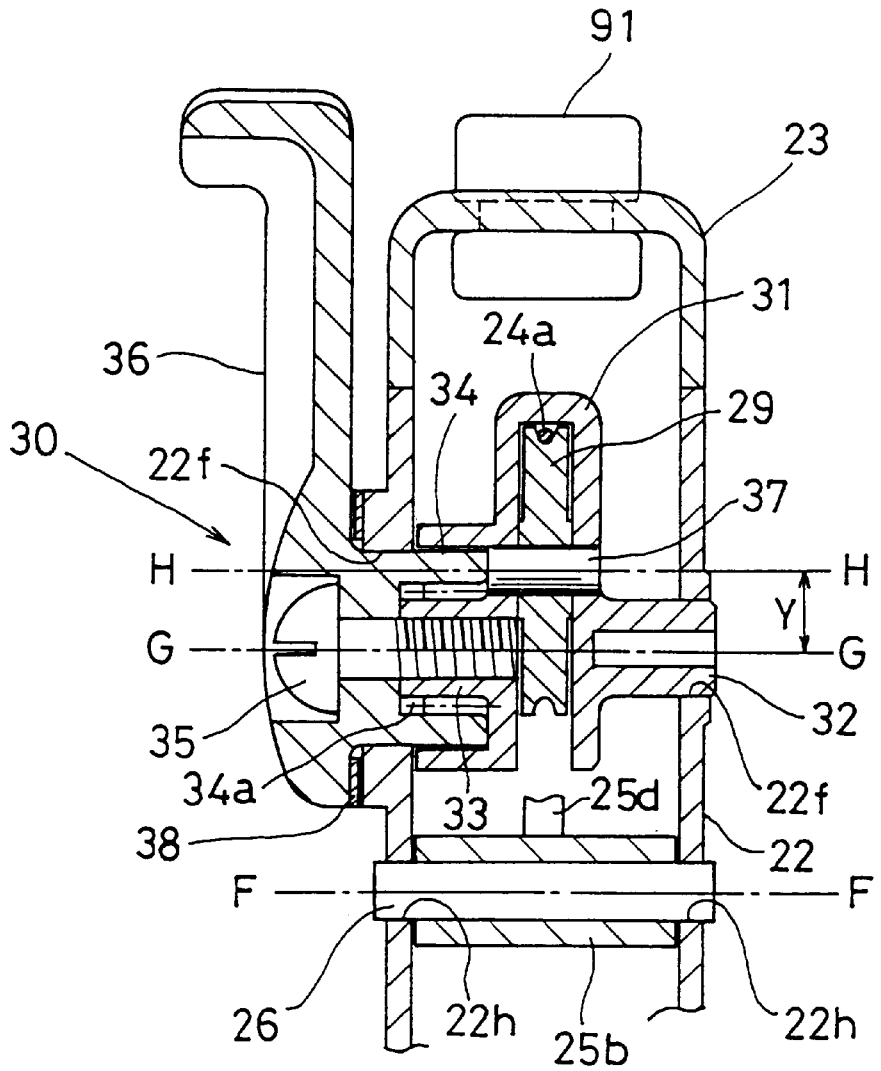
FIG. 5 is an enlarged cross-sectional view taken along the line V—V of the handling device shown in FIG. 2.

The throttle lever 25 which is rotatably secured to the main case 22 is introduced from the lower portion of the grip portion 22*k* into the hollow space in the main case 22. The throttle lever 25 has a manipulating portion 25*a* to be actuated with a finger, a cylindrical portion 25*b* as a pivot for the throttle lever 25 and externally loosely fitted around a lever-supporting pin 26 which is in turn secured along the axis F—F to the main case 22, and an actuating rod 25*d* disposed within the main case 22, extending from the cylindrical portion 25*b* in a direction opposite to the manipulating portion 25*a* and having at its distal end a roll-shaped actuating portion 25*c*. As shown in FIG. 5, both ends of the lever-supporting pin 26 are forcibly inserted into holes 22*h* formed in the main case 22. The distal end 24*b* of the throttle cable 24*a* is connected to the actuating portion 25*c*.

The closure case 23 is provided on its upper surface with a conventional safety lever 60, which is designed to prevent the throttle lever 25 from being rotated upward if the rear handle portion 20 is not properly grasped by one's hand so as to make sure that the throttle lever 25 is not inadvertently rotated in the direction to open the throttle valve CV. The closure case 23 is also provided on its upper surface with a sliding type engine stopping switch 91, which is designed to effect a short circuit of an electric circuit for the spark plug of the internal combustion engine 11, thereby stopping the engine 11.

According to this embodiment, a pair of pulleys, i.e. a standing pulley 28 and a movable pulley 29 are disposed in the main case 22. The throttle cable 24*a* extending from the throttle valve CV is wound around the standing pulley 28, i.e. entering thereinto from the lower side thereof and then extending therefrom upward, after which the throttle cable 24*a* is wound around the movable pulley 29, i.e. entering thereinto from the upper side thereof and then extending therefrom forward and downward with the distal end 24*b* of the throttle cable 24*a* being connected to the actuating portion 25*c*.

The main case 22 is provided with a position adjusting mechanism 30 which is designed to move the movable pulley 29 upward and downward. The position adjusting mechanism 30 is designed to adjust the level of the movable pulley 29, thus positioning it at a desired location and simultaneously to keep the throttle cable 24*a* in a desired pulling position. As shown in FIG. 5, the position adjusting mechanism 30 consists of a rotatable axle 32 provided thereon with a housing 31 for the movable pulley 29, an outer circumferential serration axle 33 disposed on the left side of the rotatable axle 32, and an inner circumferential serration axle 34 provided with an inner circumferential serration 34*a* engaging with the outer circumferential serration axle 33. The sub-throttle lever 36 is integrally attached to the outer end portion of the inner circumferential serration axle 34. The outer circumferential serration axle 33 is integrally secured by means of a fastening screw 35 with the inner circumferential serration axle 34.

The right end portion of the rotatable axle 32 is axially supported by a bearing portion 22*f* formed at the right side of the main case 22, and the inner circumferential serration axle 34 is axially supported by a bearing portion 22*f* formed at the left side of the main case 22. A corrugated spring washer 38 is interposed, coaxially with the inner circumferential serration axle 34, between the main case 22 and the sub-throttle lever 36 so as to keep the sub-throttle lever 36 frictionally in place with respect to the main case 22.

The movable pulley 29 in the housing 31 of the rotatable axle 32 is pivotally mounted on a supporting pin 37. In this case, the axial line H—H of the supporting pin 37 supporting the movable pulley 29 is offset from the rotating axis G—G (the axial line of the rotatable axle 32) of the sub-throttle lever 36 by a distance Y. Thus, when the sub-throttle lever 36 is rotated rearward as shown by a phantom line in FIG. 4, the movable pulley 29 is forced upward, thereby causing the throttle cable 24*a* to move in a direction of opening the throttle valve CV against the spring action which is normally biased in the direction for closing the throttle valve CV.

A stationary serration 18*b* is formed on a ring-like rear side 18*a* of the cylindrical receiver 18 of the mount base 12 so that the serrated portion extends circularly about the longitudinal axial line O—O over almost the upper semicircular range portion of the ring-like rear side 18*a*. Furthermore, as shown in FIG. 4, at the upper front portion within the main case 22, a handle-engaging member 40 is pivotally mounted on a supporting pin 41 having an axial line J—J which is parallel to the lateral axial line F—F of the throttle lever 25.

Figure 6:
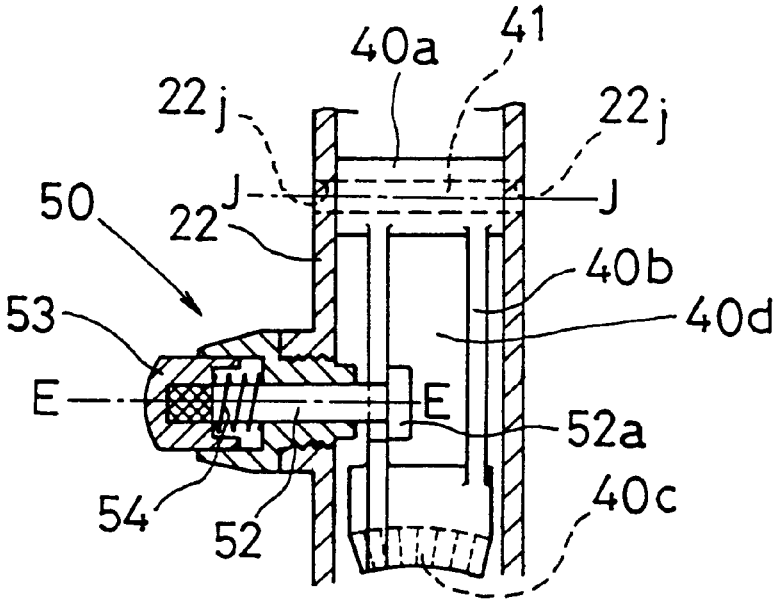
FIG. 6 is an enlarged cross-sectional view taken along the line VI—VI of the handling device shown in FIG. 2.

As shown in FIG. 6, the handle-engaging member 40 comprises a cylindrical portion 40*a* functioning as a pivot portion and loosely fitted over the axial line J—J of the supporting pin 41, an actuating arm portion 40*b* radially and downwardly extending from the cylindrical portion 40*a*, and a movable serration 40*c* formed at the lower end portion of the actuating arm portion 40*b*. As shown in FIG. 6, both ends of the supporting pin 41 are forcibly inserted into holes 22*j* formed in the main case 22.

As shown in FIG. 4, the actuating arm portion 40*b* is provided with a curved recessed portion 40*d*, the inner wall of which is adapted to be contacted by the actuation portion 25*c* of the throttle lever 25. When the throttle lever 25 is rotated, the actuation portion 25*c* moves up and down while contacting the inner wall of the curved recessed portion 40*d*, thus causing the lower portion of the handle-engaging member 40 to swing in the longitudinal direction.

The radius of curvature of the curved recessed portion 40*d* with the center at the supporting pin 26 is dimensioned as shown in FIG. 4 such that the radius of the upper half portion of the curvature is made slightly larger so as to inhibit the handle-engaging member 40 from pivotally moving at the initial stage of pulling the throttle lever 25, thus improving the manipulability of the rear handle portion 20.

The movable serration 40*c* is formed by cutting the plane of the lower end portion of the actuating arm portion 40*b* which faces the stationary serration 18*b* of the cylindrical receiver 18 into a serrated configuration, and is adapted to engage with or disengage from the stationary serration 18*b* of the cylindrical receiver 18 as the handle-engaging member 40 is pivotally moved forward or rearward in the longitudinal direction. However, the movable serration 40*c* is usually biased by a suitable biasing means (not shown) such that the movable serration 40*c* is rearwardly detached as shown by the phantom line in FIG. 4. When the handle-engaging member 40 is pushed forward in resistance to the biasing force of the biasing means, the stationary serration 18*b* engages with the movable serration 40*c*, whereby the rear handle portion 20 is locked to the mount base 12. When the pushing force is released to disengage the movable serration 40*c* from the stationary serration 18*b*, the rear handle portion 20 is made rotatable relative to the mount base 12.

Figure 7:
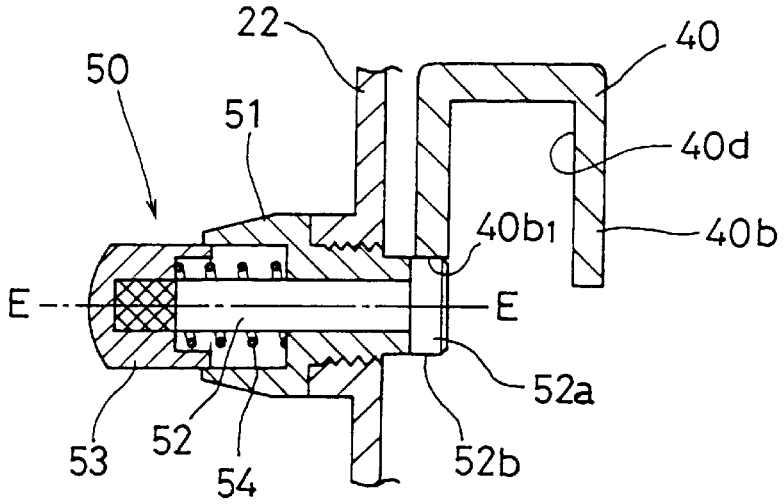
FIGS. 7(*a*) and 7(*b*) are cross-sectional views taken along the line VII—VII of an engaging member's rotation-regulating mechanism of the handling device shown in FIG. 3, wherein FIG. 7(*a*) illustrates a state wherein the movement of a handle-engaging member is restricted, and FIG. 7(*b*) illustrates a state wherein the handle-engaging member is free to move.
Figure 7:
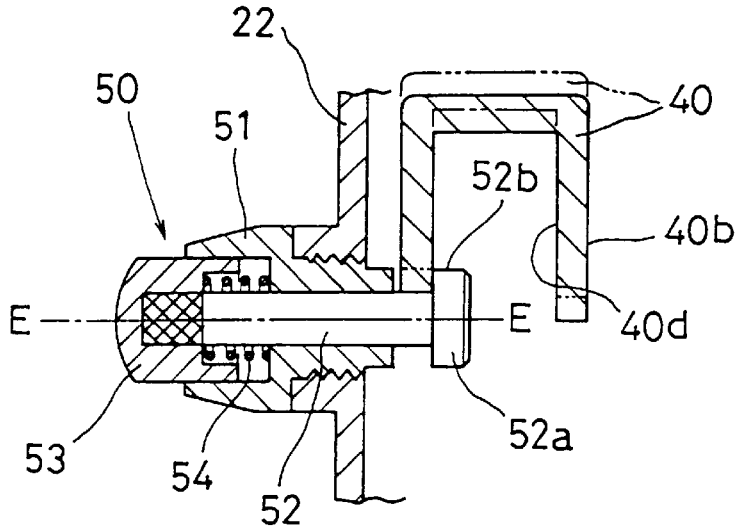

As shown in FIG. 7, an engaging member's rotation-regulating mechanism 50 is disposed in the vicinity of the handle-engaging member 40. The engaging member's rotation-regulating mechanism 50 comprises a latch body 51 screwed into the main case 22, a latch shaft 52 slidably inserted into the latch body 51 and provided at the inner end with an enlarged flange portion 52*a* which is positioned in the main case 22, a latch knob 53 press fitted to the outer end of the latch shaft 52, and a coil spring 54 which is loosely fitted on the latch shaft 52 and interposed between the latch body 51 and the latch knob 53.

Both latch shaft 52 and latch knob 53 are slidably disposed as an integral body in the latch body 51, while allowing the enlarged flange portion 52*a* to be positioned in the interior of the main case 22, and are usually biased to the left side of the main case 22 by the resilient action of the compression coil spring 54.

FIG. 7 (*a*) shows a state where the latch shaft 52 is positioned at the left outermost side of the main case 22. Under this condition, the outer circumferential wall 52*b* of the enlarged flange portion 52*a* of latch shaft 52 is located to face the end face 40*b*1 of the actuating arm portion 40*b* of the handle-engaging member 40. In this case, the rotation in the rearward direction of the handle-engaging member 40 is prevented by the enlarged flange portion 52*a*, i.e. the movable serration 40*c* of the handle-engaging member 40 engages with the stationary serration 18*b* of the mount base 12, so that the rear handle portion 20 is locked relative to the mount base 12.

FIG. 7 (*b*) shows a state where the latch knob 53 is pushed in resistance to the resilient force of the compression coil spring 54, so that the enlarged flange portion 52*a* of latch shaft 52 is entirely located within the curved recessed portion 40*d* of the actuating arm portion 40*b* of the handle-engaging member 40. In this case, the handle-engaging member 40 is biased rearward in a sufficient degree to allow the movable serration 40*c* of the handle-engaging member 40 to be disengaged from the stationary serration 18*b* of the mount base 12, so that the rear handle portion 20 is free to rotate relative to the mount base 12.

When it is desired to change the rear handle portion 20 relative to the mount base 12 in conformity with the change in working posture of the operator under conditions of FIG. 7(*a*) with the handle-engaging member 40 positioned as indicated by a solid line in FIG. 4, the latch knob 53 of the engaging member's rotation-regulating mechanism 50 can be pushed to the right with one's finger, thus obtaining a state as shown in FIG. 7 (*b*). In this state the handle-engaging member 40 can move to the rear, i.e. to a position as indicated by a phantom line in FIG. 4. If the handle-engaging member 40 is biased by a biasing means such as a spring (not shown) in the rearward direction in this case, the handle-engaging member 40 can be automatically returned to the state as indicated by a phantom line in FIG. 4, resulting in a state in which the rear handle portion 20 is disengaged from the mount base 12, and the movable serration 40*c* is detached from the stationary serration 18*b*. Accordingly, it is now possible to change the locking position of the rear handle portion 20 relative to the mount base 12 by rotating the rear handle portion 20. Furthermore, when the handle-engaging member 40 is rotated rearward, the enlarged flange portion 52*a* is prevented from moving leftward by the end face 40*b*1 of the actuating arm portion 40*b* of the handle-engaging member 40 and kept in a position as indicated by a solid line shown in FIG. 7(*b*) where the coil spring 54 is compressed.

Again to engage the movable serration 40*c* of the handle-engaging member 40 with the stationary serration 18*b* of mount base 12, the manipulating portion 25*a* of the throttle lever 25 is caused to move upward by properly grasping the rear handle portion 20. With this upward movement of the throttle lever 25, the actuation portion 25*c* of the throttle lever 25 is forced to move downward along the inner wall of the curved recessed portion 40*d* of the handle-engaging member 40 (the position as indicated by a phantom line in FIG. 4) so as to cause the handle-engaging member 40 to rotate forward (the position as indicated by a solid line in FIG. 4). As a result, the movable serration 40*c* of the handle-engaging member 40 is allowed to engage with the stationary serration 18*b* of the mount base 12, and hence the rear handle portion 20 is locked relative to the mount base 12.

When the handle-engaging member 40 is rotated forward, the end face 40*b*1 of the actuating arm portion 40*b* of the handle-engaging member 40 also moves forward, so that the blocking of leftward movement of the enlarged flange portion 52*a* of the engaging member's rotation-regulating mechanism 50 is released, thereby allowing the enlarged flange portion 52*a* to return back to the position as indicated in FIG. 7 (*a*) by the resilient force of the compressed coil spring 54, and hence the rearward rotation of the handle-engaging member 40 is again prevented.

Figure 8:
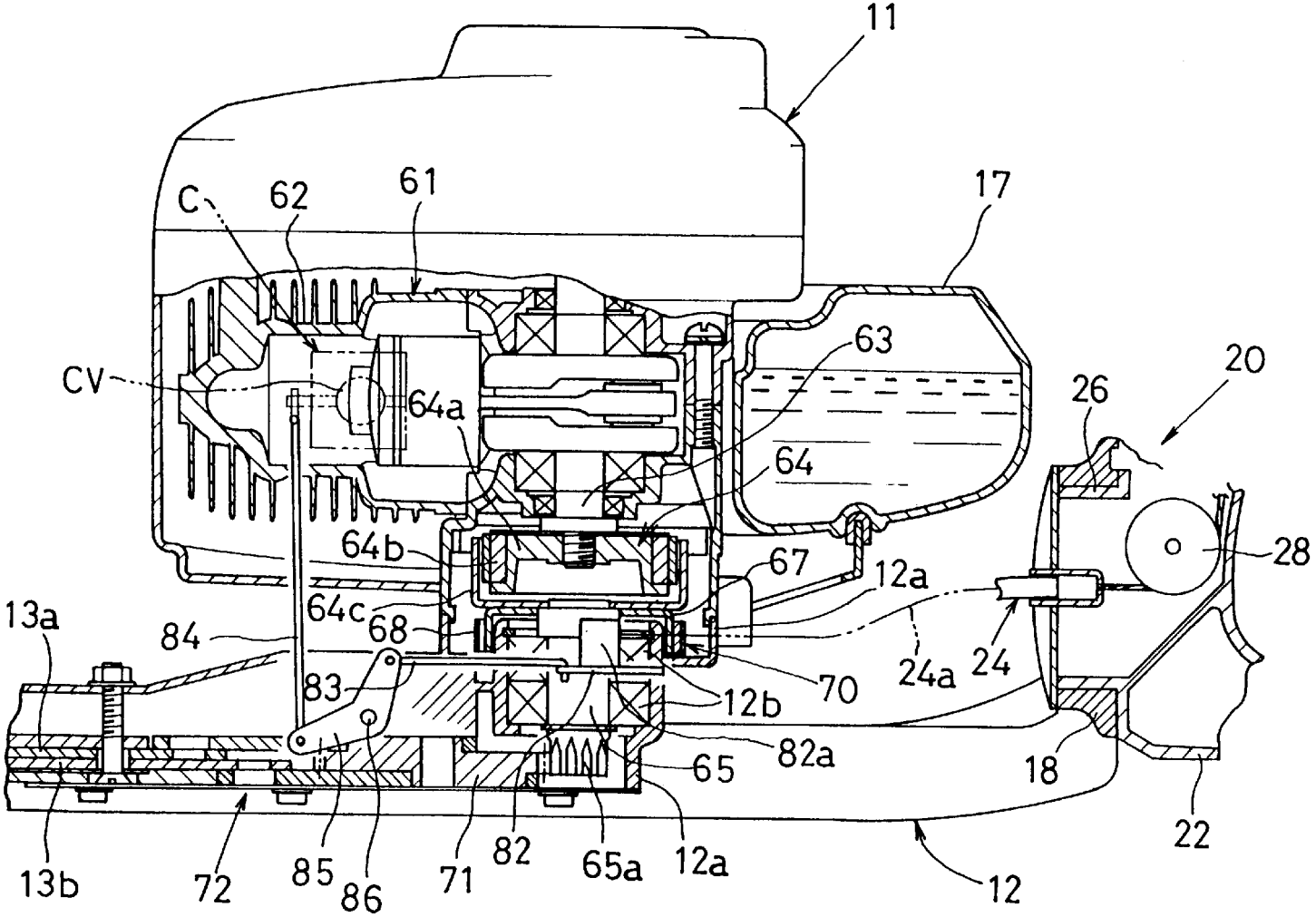
FIG. 8 is a cross-sectional view of a braking device, which is taken along the longitudinal direction of an internal combustion engine and mount base of the hedge trimmer shown in FIG. 1.
Figure 9:
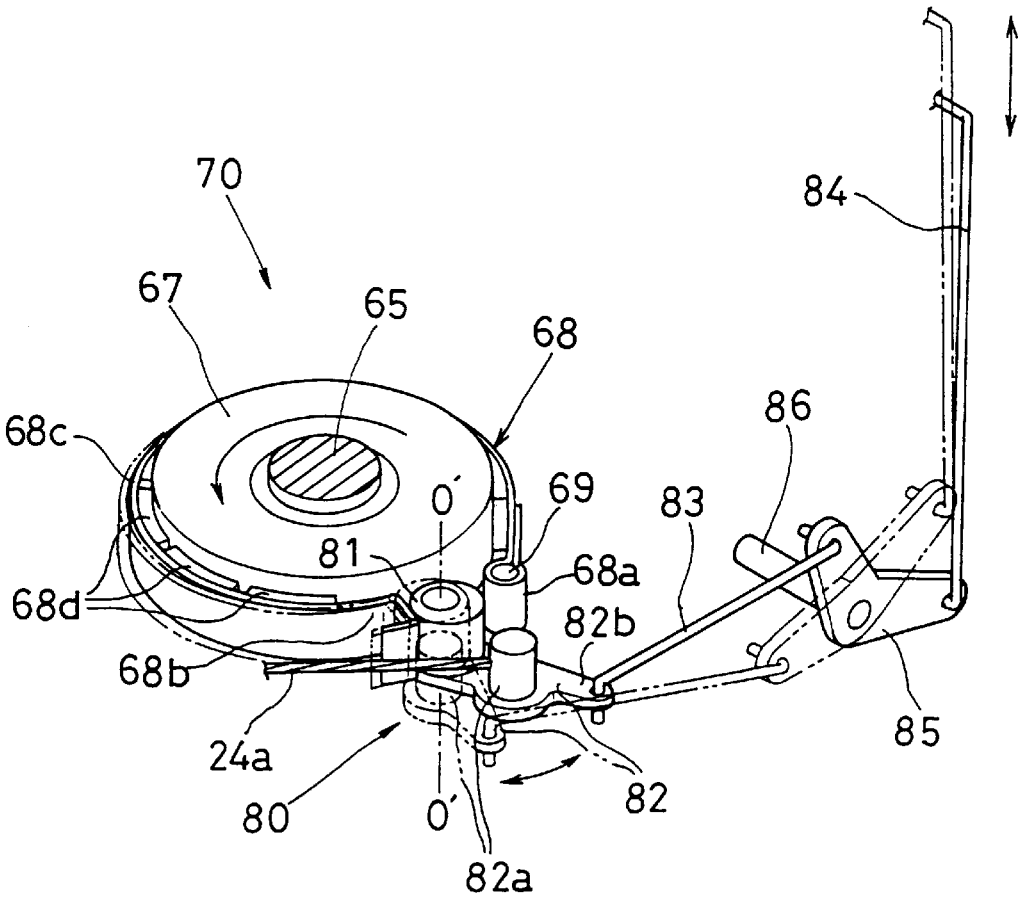
FIG. 9 is a perspective view of the braking device shown in FIG. 8 as it is viewed from the right-rearward direction.

FIG. 8 shows a cross-sectional view taken along the longitudinal direction of the internal combustion engine and mount base of the hedge trimmer shown in FIG. 1, and FIG. 9 shows a perspective view of the braking device as viewed from the right-rearward direction.

The internal combustion engine 11 is mounted on the transmission case 12*a* enclosed by the mount base 12 so that the engine main body 61 is laid down, i.e. the crank shaft 63 is set perpendicular to the mount base 12. A clutch boss 64*a* of a centrifugal clutch 64 is fixed to the lower end portion of the crank shaft 63 and fitted with clutch shoes 64*b* which are disposed so as to be movable radially by centrifugal force. A bottomed cylindrical clutch drum 64*c* is disposed outside the clutch shoes 64*b*.

A transmission shaft 65 is integrally attached to the bottom surface of the clutch drum 64*c*. When the rotation rate of the crank shaft 63 of the engine 11 exceeds a predetermined value, the clutch boss 64*a* and the clutch shoes 64*b* are integrally rotated, and simultaneously the clutch shoes 64*b* begin to shift outward due to centrifugal force, thus causing the clutch shoes 64*b* to press-contact with the inner circumferential wall of the clutch drum 64*c*. As a result, the clutch drum 64*c* rotates integrally with the clutch shoes 64*b*, and hence the revolving power of the internal combustion engine 11 is transmitted via the transmission shaft 65 to the working portion 13.

The transmission shaft 65 is rotatably supported on the bearings 12*b* and disposed in the transmission case 12*a*. A small gear wheel 65*a* formed on the lower end portion of the transmission shaft 65 is engaged with a large gear wheel 71 which is rotatably supported in the transmission case 12*a* and provided on both of its surfaces with eccentric cam disks, whereby the revolving power of the transmission shaft 65 can be transmitted via the large gear wheel 71 to the reciprocating motion mechanism 72 of the clipper blades 13*a* and 13*b*.

A bottomed cylindrical brake drum 67 of a braking device 70 is integrally attached to the lower portion of the clutch drum 64*c*, and a brake band 68 is wound around the outer circumferential wall of the brake drum 67.

As shown in FIG. 9, the brake band 68 is made of a plate spring having a predetermined width, and an intermediate portion 68*c* thereof is formed into a circular shape which is constrained to a small size due to the resilient force thereof, but is capable of conforming to the outer circumferential wall of the brake drum 67. One end portion 68*a* of the brake band 68 is formed into a loop and is pivotally supported on a supporting pin 69 fixed to the transmission case 12*a*. The other end portion 68*b* of the brake band 68 is formed into a U-shape and adapted for contacting by an eccentric cam 81. The inner surface of the intermediate portion 68*c* of the brake band 68 is provided with a plurality of friction members 68*d* of suitable length which are equidistantly spaced apart and adhered onto the aforementioned inner surface of the brake band 68 by means of an adhesive for instance.

As seen from FIG. 9, a band-manipulating mechanism 80 is disposed as a means to manipulating the brake band 68 in the vicinity of both end portions 68*a* and 68*b* of the brake band 68. The band-manipulating mechanism 80 is provided with the eccentric cam 81, and also with an arm link 82 which is integrally formed with the eccentric cam 81. The eccentric cam 81 is pivotally supported in the transmission case 12*a* so as to be rotated about the vertical axis O'—O', and the outer circumferential surface of the eccentric cam 81 is contacted with the U-shape end portion 68*b* of the brake band 68. The arm link 82 is connected, via a cable-clamping portion 82*a* which is set away from the vertical axis O'—O', with the throttle cable 24*a* extending from the throttle lever 25 of the rear handle portion 20.

A manipulating link 84 for rotating the throttle valve CV extends downward from the throttle valve CV of the engine 11, and the lower end portion of the manipulating link 84 is connected via the V-shaped link 85 and another manipulating-link 83 with the free end 82*b* of the arm link 82.

When the throttle cable 24*a* is pulled by manipulating the throttle lever 25 so as to cause the arm link 82 to rotate about the vertical axis O'—O', the eccentric cam 81 also rotates integrally with the arm link 82, thus actuating the eccentric outer circumferential surface thereof to push the U-shape end portion 68*b* of the brake band 68. Since the brake band 68 is pivotally supported through its one end portion 68*a* on the supporting pin 69, the pivot position thereof is kept stationary, but the brake band 68 is forced to move for its diameter to be widened by the pressure effected by the U-shape end portion 68*b*. As a result, the brake band 68 (which has been press-contacted, via the friction members 68*d*, with the brake drum 67 so as to prevent the brake drum 67 from being rotated when the throttle cable 24*a* is not pulled) is now detached from the surface of the brake drum 67 due to the widening in diameter of the brake band 68, thus releasing the braking.

Furthermore, when the arm link 82 is rotated, the another manipulating link 83 moves, and hence the V-shaped link 85 rotates about the horizontal supporting pin 86, and the manipulating link 84 is moved downward, in the direction to open the throttle valve CV.

The eccentric cam 81 is designed such that the dimention of the lift thereof is suitably set so that the brake band 68 can always remain in the non-braking state when its rotational position exceeds a predetermined position which corresponds to the rotation rate of clutch-in of the centrifugal clutch 64.

Since the cable 24*a* is always biased in the direction to close the throttle valve CV by a spring (not shown) disposed in the vicinity of the throttle valve CV, when one's finger is released from the throttle lever 25 so as to release the pull of the cable 24*a*, the eccentric cam 81 rotates in the direction opposite to the aforementioned direction, whereby the pressure of the brake band 68 against the U-shape end portion 68*b* is weakened, and hence the friction members 68*d* are again allowed to contact with the brake drum 67, thereby actuating the braking of the brake drum 67.

Next, the operation of the aforementioned handling device (rear handle portion) 20 according to this embodiment will be described.

With the rear handle portion 20 of this embodiment, the internal combustion engine 11 is started by operating the recoil starter 16 under conditions where the rear handle portion 20 is locked in place to the mount base 12 (a state indicated by a solid line in FIG. 2), the throttle lever 25 is positioned in the non-operation state (a state shown in FIG. 2), and the sub-throttle lever 36 is rotated forward (in the direction of working portion 13) (a state indicated by a phantom line in FIG. 2). However, since the internal combustion engine 11 is in a state of idling and low in engine speed under these conditions, the centrifugal clutch 64 which is interposed between the engine 11 and the power transmission device cannot be actuated. In this case, since the brake band 68 of the braking device 70 is frictionally contacted with the outer circumferential surface of the brake drum 67 due to the contracting spring force to shrink the diameter of the brake band 68, thereby braking the rotation of the brake drum 67, the clipper blades 13*a* and 13*b* of the working portion 13 are prevented to move reciprocally.

Under these conditions, the safety lever 60 is pushed downward with the palm of the hand, properly grasping the handle portion 20 so as to release the lock of the throttle lever 25, after which the manipulating portion 25*a* of the throttle lever 25 is rotated up to the uppermost position with a finger, thereby allowing the actuating portion 25*c* of the throttle lever 25 to move downward, thus pulling the throttle cable 24*a* for a predetermined distance via the standing pulley 28 and the movable pulley 29. As a result, the throttle cable 24*a* is tensioned without play. However, the throttle valve CV is still maintained in the state of minimum opening.

In this case, the pulling distance (valve 7 of displacement) of the throttle cable 24*a* by the throttle lever 25 is the same as the distance of movement of the actuating portion 25*c*.

Then, while keeping the throttle lever 25 rotated at the uppermost position, the sub-throttle lever 36 is rotated rearward to a desired position in resistance to the resilient force of the corrugated spring washer 38, the movable pulley 29 is shifted upward, thereby pulling the throttle cable 24*a* upward. Since the end portion 24*b* of the throttle cable 24*a* is connected to the actuating portion 25*c* and prevented from moving, the throttle cable 24*a* is pulled in the direction to open the throttle valve CV, and hence the throttle valve CV is moved from the minimum opening degree (idling opening) up to the full opening, thereby adjusting the opening degree of the throttle valve CV. As a result, the rotation rate of the engine 11 is increased and the centrifugal clutch 64 is brought into a state of clutch-in. On the other hand, the eccentric cam 81 of the band-manipulating mechanism 80 also rotates, thus actuating the brake band 68 to move in the direction to widen the diameter thereof, thereby releasing the braking of the brake drum 67. As a result, the power of the engine 11 can be transmitted to the clipper blades 13*a* and 13*b* through the centrifugal clutch 64, the transmission shaft 65 and the reciprocating motion mechanism 72, thus allowing for reciprocating motion of the clipper blades 13*a* and 13*b* for hedge cutting.

If the sub-throttle lever 36 is turned to a predetermined position at which one's finger is released from the sub-throttle lever 36, the sub-throttle lever 36 is kept immobilized at that position by the effect of the resilience force of the corrugated spring washer 38, and hence the throttle valve CV is kept at this opening degree (a predetermined opening degree). As a result, the load on one's hand can be alleviated.

If the rotation rate of the internal combustion engine 11 is desired to be greatly reduced, e.g due to an unexpected accident, and under conditions where the opening degree of the throttle valve CV is being suitably controlled as mentioned above, one's had releases the throttle lever 25. As a result, since the throttle cable 24*a* is biased in the direction to close the throttle valve CV, the throttle lever 25 is forcibly pulled back to the original position, thus allowing the throttle cable 24*a* to return to the non-manipulation state, causing the throttle valve CV to take the previous idling opening degree, for the internal combustion engine 11 to take an idling state.

In the case of the hedge trimmer 10 which is designed to transmit the rotational driving force of the internal combustion engine 11 to the working portion 13 formed by the clipper blades 13*a* and 13*b* via a centrifugal clutch 64, when the rotation rate of the internal combustion engine 11 is reduced, the centrifugal clutch 64 takes a cutoff state, thus resulting in cutoff of power transmission to the working portion 13. In this case, even if power transmission is cut off in this manner, the reciprocating motion of working portion 13, i.e. the clipper blades 13*a* and 13*b* tends to continue due to the inertia of motion. However, due to the elastic restoring force of the brake band 68, the brake band 68 is immediately deformed, contracting the diameter thereof concurrent with the movement of the throttle valve CV to take the idling opening state, whereby the rotation of the brake drum 67 is prevented. Therefore, the reciprocating motion of the clipper blades 13*a* and 13*b* can be immediately suspended simultaneously with the movement of the engine 11 taking the idling condition.

When the throttle lever 25 is again manipulated to rotate up to the predetermined uppermost position with one's finger after the throttle lever 25 has been released as described above, the play of the throttle cable 24*a* is eliminated and the throttle valve CV returns to the previous opening degree which has been set prior to the previous releasing manipulation of the throttle lever 25, since the sub-throttle lever 36 is kept in the previous manipulation position. As a result, there is no need to readjust the sub-throttle lever 36.

With the handling device 20 of this embodiment it is possible to adjust the opening degree of the throttle valve CV (a member to be driven) by means of the cable 24*a* by making use of the throttle lever 25 and the sub-throttle lever 36, and also , the operation of the revolving power transmission portion in the vicinity of the working portion 13 at the moment of shifting the engine 11 to the idling condition can be controlled by the manipulation of the throttle lever 25 and the sub-throttle lever 36, so that there is little possibility that the reciprocating motion of the working portion 13, i.e. the clipper blades 13*a* and 13*b* is inadvertently actuated.

Since the throttle cable 24*a* is pulled through the movable pulley 29 with the throttle cable 24*a* being wound around the movable pulley 29 in the manipulation of the sub-throttle lever 36 of the position-adjusting mechanism of this embodiment, the throttle cable 24*a* is pulled for a distance which is almost twice as large as the shifted distance of the movable pulley 29. Therefore, the distance of manipulating the sub-throttle lever 36, which is required for adjusting the opening degree of the throttle valve CV, i.e. the distance of shifting the movable pulley 29 can be reduced to half of that of the throttle cable 24*a*, thus making it possible to miniaturize the apparatus.

Additionally, it is possible to adjust the opening degree of the throttle valve CV to a desired degree by the manipulation of the throttle lever 25 and the sub-throttle lever 36, and also to immediately return to the minimum opening degree (opening for idling). Therefore, high operational safety can be assured and finger fatigue can be avoided. When it is desired to reset the throttle valve CV to the opening degree which has been set before the throttle valve CV is returned to that for idling, this can be realized automatically without requiring re-adjustment of the handling device.

In the foregoing, the invention has been described with reference to a specific preferred embodiment. However, the present invention is not limited by this embodiment and may be variously modified within the spirit of the invention and the scope of the appended claims.

As seen from the above description, since the handling device of the invention is provided with a throttle lever connected with one end portion of a cable, and a movable pulley around which a portion of the cable in the vicinity of the aforementioned one end portion is wound as a turn-around point, and is constructed such that the movable pulley can be held at a desired position by means of the sub-throttle lever, the area required for rotating the sub-throttle lever can be minimized, thus making it possible to miniaturize the handling device as a whole. It is also possible according to the handling device of the invention to provide a throttle lever mechanism, which is capable of setting the opening degree of the throttle valve to a desired degree even under conditions where the throttle lever is rotated to a full extent, and also capable of immediately returning the throttle lever to the minimum opening degree (idling opening).

I claim:

1. A handling device for a power working machine comprising an internal combustion engine and a working portion which is operationally coupled to the internal combustion engine, wherein the handling device comprises:

a throttle lever attached to one end portion of a cable, configured and disposed for pulling the cable connected at its other end to a throttle valve of the internal combustion engine; and a position adjustment mechanism comprising a sub-lever bearing a pulley around which the cable in the vicinity of its one end portion is wound as a turn-around point, with the sub-lever being disposed and configured for moving the pulley to a desired holding position and thereby to adjust a distance of pulling the cable.

2. A handling device for a power working machine comprising an internal combustion engine, a working portion which is operationally coupled to the internal combustion engine via a centrifugal clutch, and a brake for the working portion, wherein the handling device comprises:

a throttle lever connected to one end portion of a cable, configured and disposed for pulling the cable connected at its other end to a throttle valve of the internal combustion engine and to the brake for the working portion; and a position adjustment mechanism comprising a sub-lever bearing a pulley around which the cable in the vicinity of its one end portion is wound as a turn-around point, with the sub-lever being disposed and configured for moving the pulley to a desired holding position and thereby to adjust a distance of pulling the cable.

3. The handling device according to claim 1 or 2 disposed in a main case, wherein:

the position adjusting mechanism further comprises a rotatable axle with a housing within which the movable pulley is rotatably, eccentrically and axially supported, with an outer circumferential serration axle being disposed on one end portion of the rotatable axle and an inner circumferential serration axle being disposed with an inner circumferential serration engaging with the outer circumferential serration axle;

the sub-lever is integrally attached to one end portion of the inner circumferential serration axle;

the outer circumferential serration axle is secured by means of a fastening screw to the inner circumferential serration axle; and the rotatable axle and the inner circumferential serration axle are pivotally mounted on the main case.

4. The handling device according to claim 3, wherein a corrugated spring washer is interposed between the sub-lever and the main case.

5. The handling device according to claim 1 or 2 with the power working machine comprising a mount base, further comprising a handle-engaging member which is pivotally supported on the mount base for locking the handling device to the mount base and which is configured and disposed to be rotated in accordance with a rotation of the throttle lever so as to be engaged with the mount base, thereby locking a rotation of the handling device.

* * * * *